US008739844B2

(12) United States Patent
Patsch et al.

(10) Patent No.: US 8,739,844 B2
(45) Date of Patent: Jun. 3, 2014

(54) CUTTING TOOL WITH A SUPPORTING BODY

(75) Inventors: Richard Patsch, Riedau (AT); Zelkjo Pekec, Riedau (AT); Franz Standler, Zell an der Pram (AT)

(73) Assignee: Leitz GmbH & Co. KG, Oberkochen (DE)

( * ) Notice: Subject to any disclaimer, the term of this patent is extended or adjusted under 35 U.S.C. 154(b) by 292 days.

(21) Appl. No.: 12/599,364

(22) PCT Filed: May 9, 2008

(86) PCT No.: PCT/DE2008/000811
§ 371 (c)(1),
(2), (4) Date: Sep. 1, 2010

(87) PCT Pub. No.: WO2008/138326
PCT Pub. Date: Nov. 20, 2008

(65) Prior Publication Data

US 2010/0319810 A1 Dec. 23, 2010

(30) Foreign Application Priority Data

May 9, 2007 (DE) ..... 10 2007 022 242

(51) Int. Cl.
*B27G 13/00* (2006.01)

(52) U.S. Cl.
USPC ..... 144/235; 407/46; 407/47

(58) Field of Classification Search
USPC ..... 144/235, 230, 136.95, 219, 174; 241/92, 278.1, 292.1, 296, 298; 407/40, 42, 46, 47, 49, 407, 111
See application file for complete search history.

(56) References Cited

U.S. PATENT DOCUMENTS

| | | | | |
|---|---|---|---|---|
| 4,193,719 | A | 3/1980 | Oaks | |
| 4,275,853 | A * | 6/1981 | Kreuz et al. | 241/294 |
| 5,224,408 | A | 7/1993 | Steidinger | |
| 6,004,079 | A | 12/1999 | Kislinger | |
| 6,386,250 | B1 * | 5/2002 | Liu | 144/231 |
| RE38,930 | E * | 1/2006 | Swartwood et al. | 144/176 |
| 7,140,408 | B1 * | 11/2006 | Hinchliff et al. | 144/241 |
| 2002/0046632 | A1 | 4/2002 | Wallin et al. | |
| 2007/0034291 | A1 | 2/2007 | Moran et al. | |

FOREIGN PATENT DOCUMENTS

| | | |
|---|---|---|
| DE | 818850 | 10/1951 |
| DE | 1195934 | 10/1957 |
| DE | 92 10 363.4 | 8/1992 |
| EP | 1568453 A1 | 8/2005 |
| EP | 1574308 | 9/2005 |
| JP | 4-70404 | 6/1992 |

* cited by examiner

*Primary Examiner* — Shelley Self
*Assistant Examiner* — Matthew G Katcoff
(74) *Attorney, Agent, or Firm* — Whitham Curtis Christofferson & Cook, PC

(57) ABSTRACT

The invention relates to a cutting tool with a supporting body and at least one receptacle (2), which is arranged in the supporting body (1), is openly formed to allow a cutting edge (3) of a cutting element (4) to pass through and in which the cutting element (4) is clamped in its seat by means of at least one clamping jaw (5). The object of the invention is to improve the cutting tool with respect to the cutting behavior and cost-effectiveness. This object is achieved by the cutting jaw (5) being formed resiliently in the direction of the cutting element (4).

15 Claims, 7 Drawing Sheets

CUTTING TOOL WITH A SUPPORTING BODY

FIELD OF THE INVENTION

The invention relates to a cutting tool with a supporting body according to the preamble of claim 1. The invention also relates to a cutting element for a cutting tool as such.

BACKGROUND

Cutting elements of the type in question are known in which a cutting element and a movable clamping jaw are arranged in a supporting body in a formed receptacle, wherein the clamping jaw clamps the cutting element in its seat via centrifugal forces. In such a cutting tool, the fitting and correct orientation of the cutting element and also the removal are relatively complicated and there is the risk of the cutting element slipping when the tool is stopped.

Furthermore, cutting tools are known in which a cutting element is fastened in a receptacle of a supporting body by means of screwing. In this case, it is important that the bearing surfaces of the clamping jaws, of cutting elements and of the seat of the cutting elements are designed to be flat in order to ensure a uniform contact force. Problems with the regrinding occur in such a cutting tool, since reground cutting elements are inclined with respect to the seat, with the result that the contact force is reduced in particular in the region of the cutting edge of the cutting element.

The blade then vibrates during the machining operation, which results in an untidy cut; in the extreme case, chips can penetrate between the seat and the cutting element. The same problem occurs if no flat bearing surfaces can be provided on account of production tolerances.

SUMMARY

The object of the invention is to improve the cutting tool with regard to the cutting behavior and economic efficiency.

This object is achieved by a cutting tool having the features of claim 1.

Due to the elastic design of the clamping jaws in the direction of the cutting element, the cutting element in the region of the cutting edge is fixedly clamped in its seat even when deviations with respect to the flatness of the bearing surfaces of the cutting element occur on account of rework of the cutting element or on account of production tolerances. Inaccuracies which can occur if the cutting element is inserted obliquely or if the supporting body is already deformed as a result of prolonged use are thus likewise compensated for. Due to the reliable bearing of the cutting element in the region of the cutting edge against the seat in the receptacle of the supporting body, the vibration behavior of the cutting element is influenced in a positive manner, thereby making possible a neat cut. On account of the possibility of regrinding the cutting element, the tool costs are reduced, and therefore the economic efficiency of the cutting tool overall is increased.

One configuration of the invention provides for the elastic design of the clamping jaw to be achieved by a weakened location of the clamping jaw on the side facing away from the cutting element. The elastic configuration can likewise also be set by a suitable material selection or suitable component dimensioning.

As an alternative to a weakened location, a recess can be formed in the clamping jaw on the side facing away from the cutting element; for example said recess can be incorporated by a cutting-off process or by corresponding fashioning during the forming process. Of course, a plurality of weakened locations or recesses can be provided in the clamping jaw. An "elastic hinge" is provided by the weakened location of the clamping jaw on the side facing away from the cutting element, as a result of which the clamping jaw bears elastically against the cutting element and presses the latter into its seat in the receptacle of the supporting body. Depending on the configuration or the requirements profile of the clamping jaw or jaws, provision is made for one or more weakened locations to be provided, wherein the weakened locations or recesses extend over the entire axial width of the clamping jaw or jaws in order to increase the spring effect. If a plurality of weakened locations or recesses are provided, they are advantageously arranged substantially parallel to one another; however, the recesses or weakened locations can also be arranged in an adapted manner such as to differ from a parallel orientation for adaptation to specific blade geometries or intended uses which cause a specific wear behavior. Thus, for example, in a profile milling tool in which regions of the cutting element are subjected to different loads, said regions can react to the different loads with an appropriate arrangement and orientation of the recesses or weakened locations in the clamping jaw in order to adapt the contact force as a function of the respective load.

In order to increase the spring effect or specifically set the spring effect, a spring element is arranged in the weakened location or recess, said spring element loading the clamping jaw in such a way that the clamping jaw is prestressed in the direction of the cutting edge of the cutting element. The spring element preferably consists of an elastic material or a compression spring and causes the weakened location or recess to expand, thereby increasing the spring force in the top and bottom end regions of the clamping jaw.

An inexpensive and effective configuration of the recess or of the weakened location is a groove or a plurality of grooves which are incorporated in the clamping jaw. This groove can be adapted in shape and size to the respective intended use and can be incorporated in the clamping jaw in a simple manner by grinding or milling. A corresponding configuration of the groove facilitates the arrangement of the spring element in the form of an elastic plastic or a compression spring, since reliable fastening of the spring element on the clamping jaw in the groove is ensured by a corresponding cross-sectional form.

A development provides for the clamping jaw to be designed to be bent in the direction of the cutting element and to consist of a metal or plastic piece. This bending acts as a type of prestress and assists the elastic effect on the cutting element, thereby increasing the contact pressure in particular in the region of the cutting edge of the cutting element.

In order to be able to reliably clamp and secure the cutting element in its seat, the clamping jaw is connected to the supporting body via a screwed connection. In addition, the adjustability of the contact pressure is made possible via the screwed connection by virtue of the fact that the tightening torque of the screw can be varied and set. Furthermore, depending on the intended use, different clamping jaws can be used, which is simple to realize via a detachable connection by means of the screwing.

A development provides for a projection to be arranged on the clamping jaw in the direction of the cutting element, said projection engaging in a corresponding recess in the cutting element. Alternatively, the projection can also be arranged on the cutting element and engage in a recess in the clamping jaw. The projection and the recess are designed for axially or radially locking the cutting element and help to secure the cutting element in the seat of the supporting body. In addition to or as an alternative to the projection or the recess, an axial locking element for the cutting element is provided on the supporting body in order to prevent a lateral displacement of the cutting element.

For the purposes of maintenance and adaptation to the material or to the workpiece to be produced, the cutting element is advantageously fastened to the supporting body in an interchangeable manner, which is facilitated in particular by a screwed connection of the clamping jaw.

In addition to the clamping jaw being designed to be elastic in the direction of the cutting element, provision is made for the clamping jaw to be designed to be elastic in the direction of the cutting edge in order to obtain an optimum restraint of the cutting element and precise guidance of the cutting edge.

A development of the invention provides for an indicating recess, in particular an indicating groove, which indicates the end of a regrinding zone to be ground in the cutting element. As a result, it is possible to provide the cutting tool with a cutting element that can be reground. The aim here is to be able to transmit a high clamping force to the cutting element despite decreasing material thickness during repeated regrinding. When an elastic clamping jaw is used, only a precisely defined variation in the material thickness of the cutting element is permissible, since sufficiently reliable clamping of the cutting element and sufficient precision when setting the cutting tool must be ensured. The permissible tolerances for the material thickness of the cutting element and thus for the depth of the indicating recess are extremely small, and therefore grinding of an indicating recess, in particular an indicating groove, is advantageous on account of the small tolerances during the grinding.

The cutting tool is advantageously designed as a cutter block or a cutter head of a woodworking machine; however, it is possible to also use this cutting tool for working metal, plastic or stone.

DESCRIPTION OF THE DRAWINGS

An exemplary embodiment of the invention is described below with reference to the attached figures. The same designations in various figures designate the same components. In the drawing:

FIGS. 5A to 10B show various embodiments of clamping jaws in a sectional illustration and an oblique plan view;

FIGS. 11*a* to 11*c* show a cutting element according to FIG. 11 in side view; and FIGS. 12A to 15B show various embodiments of clamping jaws in a sectional illustration and an oblique plan view.

DETAILED DESCRIPTION

Figure 1:
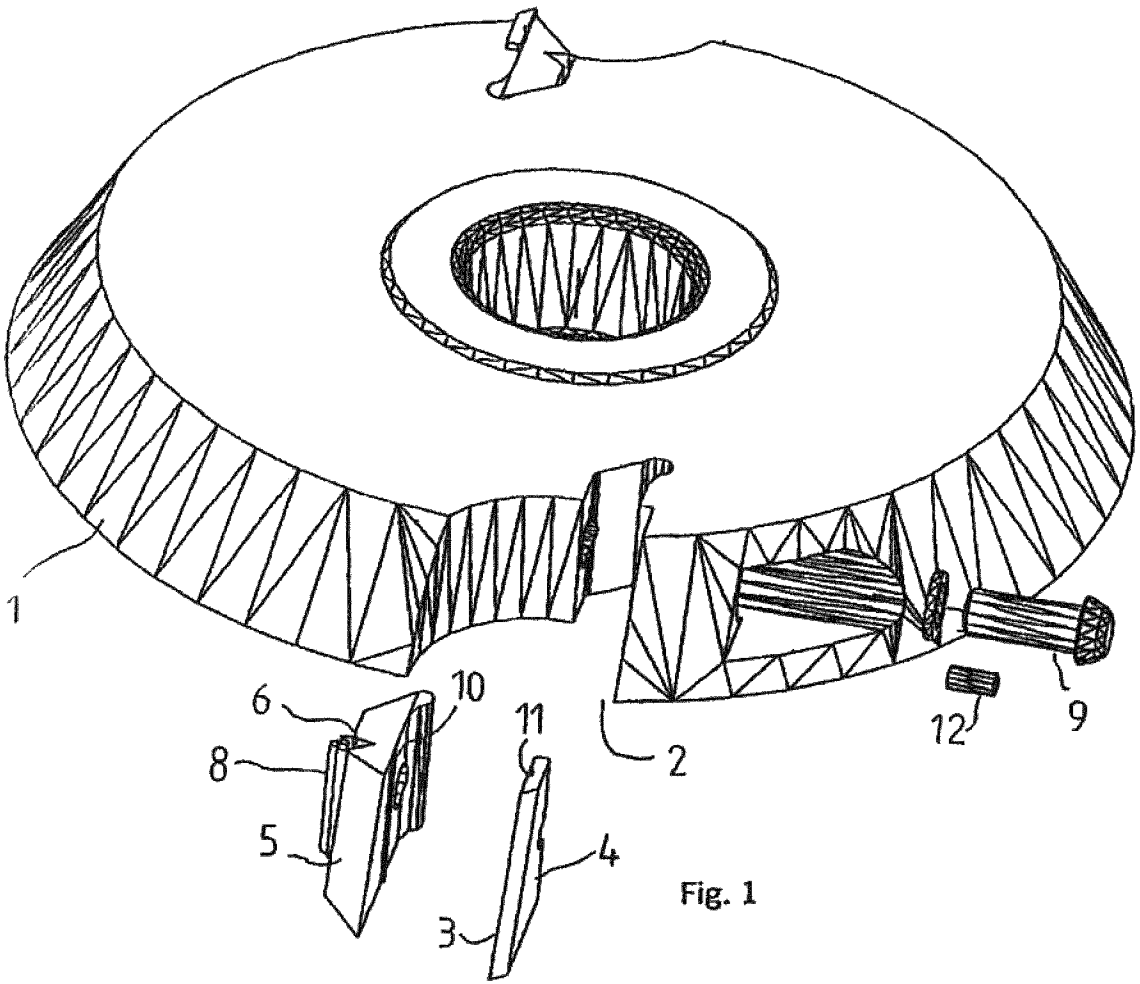
FIG. 1 shows an oblique plan view of a cutting tool in an exploded illustration.

FIG. 1 shows a cutting tool having a supporting body 1 and a receptacle 2 incorporated therein. The receptacle 2 can either have been incorporated in the mold during the process of forming the supporting body 1 or else can be incorporated subsequently by milling, grinding or another machining process. The receptacle 2 serves as a seat for a cutting element 4, the cutting edge 3 of which extends radially outward from the supporting body 1 in the exemplary embodiment shown. In addition to a cutting edge 3 directed radially outward, the cutting edge 3 can also extend radially inward, e.g. in the case of a spinning tool.

The cutting element 4 is inserted into the receptacle 2 in its seat, wherein a clamping jaw 5 which clamps the cutting element 4 is arranged opposite the seat.

The clamping is effected by means of a screw 9 which, through a through-hole in the supporting body 1, engages in a thread incorporated in the clamping jaw 5 and clamps the cutting element 4 in place after application of a fixed torque.

Incorporated on that side of the clamping jaw 5 which faces away from the cutting element 4 is a groove 6, which results in a weakened location on account of the absence of material, and this weakened location results in a hinge effect in the region of the groove 6. Inserted into this groove 6 is a compression spring 8 which pushes apart the parts of the clamping jaw 5 on both sides of the groove 6 and thus enables the clamping jaw 5 to bear elastically against the cutting element 4, in particular in the region of the cutting edge 3. The compression spring 8 is shown schematically in the exemplary embodiment and represents all the compression spring elements which can widen the groove 6. The clamping jaw 5 is, as it were, prestressed and curved, such that the ends of the clamping jaw 5 pointing radially outward or inward are preloaded elastically.

Also formed on the clamping jaw 5 is a projection 10 which engages in a corresponding groove 11 in the cutting element 4 and which, in addition to the clamping force applied by the screw 9, forms positive locking against a radial displacement of the cutting element 4 on account of centrifugal forces that occur. The arrangement and functioning of an axial locking means 12 is explained with reference to the following figures.

Figure 2:
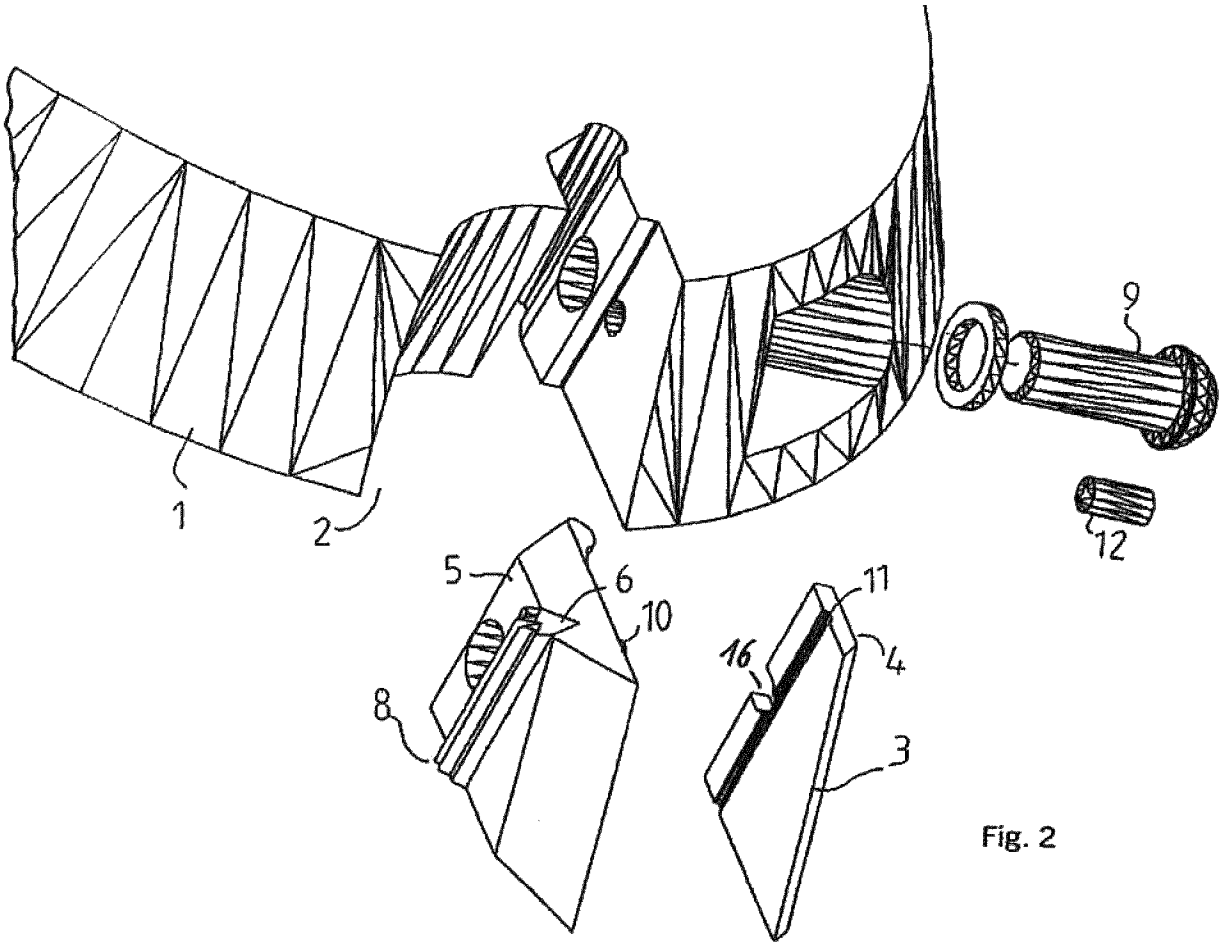
FIG. 2 shows a detailed view of FIG. 1 from another angle.

FIG. 2 shows in an enlarged detailed illustration that the axial locking element 12 designed as a stud is passed through a hole right into the seat of the cutting element 4 in the receptacle 2. Located radially further inward is the through-hole for the screw 9, which engages in a thread of the clamping jaw 5 and the head of which forms a locking means for the axial locking element 12 after the screwing. The clamping jaw 5 forms the other bearing surface for the axial locking element 12, such that the latter is secured in the fitted state. Incorporated in the cutting element 4 is a recess 16, which is designed to correspond to the axial locking element 12 and encloses the axial locking element 12 in the fitted state. In this way, a displacement of the cutting element 4 in the axial direction is prevented.

The design of the groove 6 in the clamping jaw 5 and the compression spring 8 arranged inside the groove 6 likewise become clear in FIG. 2. The groove 6 extends over the entire axial width of the clamping jaw 5, such that a spring effect in the direction of the cutting edge 3 of the cutting element 4 can be produced over the entire width of the clamping jaw 5. In the fitted state, the recess 11 in the cutting element 4 engages on the projection 10 of the clamping jaw 5 and prevents a radial displacement of the cutting element 4 during operation of the cutting tool.

Figure 3:
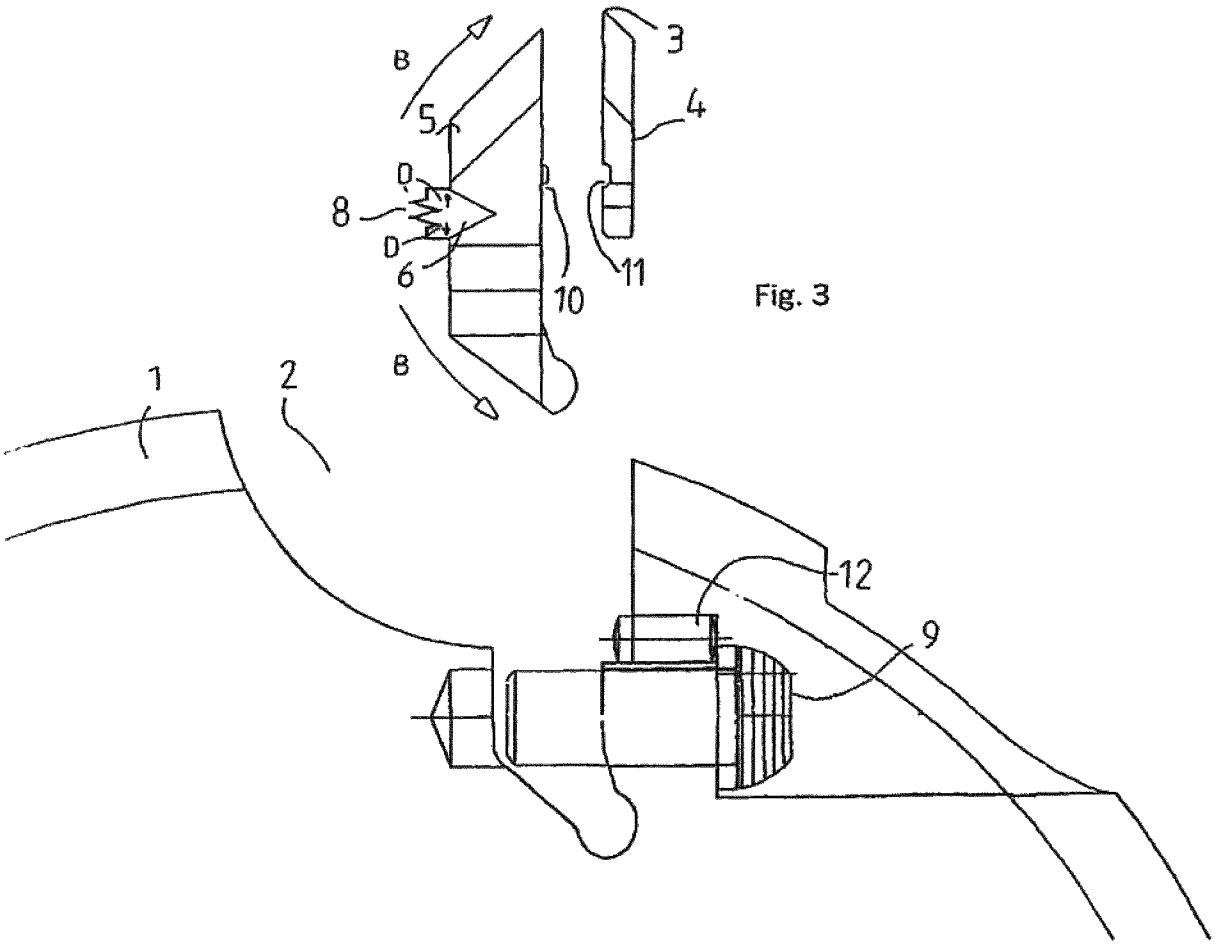
FIG. 3 shows a sectional illustration of the cutting tool before assembly.

The arrangement of the cutting element 4, of the clamping jaw 5 and of the supporting body 1 becomes clear in FIG. 3, as does the effect of the compression spring 8 arranged in the groove 6. The compression spring 8 causes the groove 6 to widen at the edges remote from the cutting element 4, as shown by the arrows D. The outer and inner ends of the clamping jaw 5 are bent or prestressed in the direction of the cutting element 4, as viewed radially, by this pressure, as indicated by the arrows B. This prestress can also be introduced in the course of the manufacturing process. Whereas the radially inwardly directed end of the clamping jaw 5 is secured by the screw 9 and a corresponding milled-out portion in the supporting body 1, that end of the clamping jaw 5 which faces the cutting edge 3 can be displaced in the direction of the cutting element 4 on account of the hinge-like weakened location produced by the groove 6, thereby resulting in the cutting element 4 being elastically prestressed and in an increased contact pressure being applied to said cutting element 4 in the region of the cutting edge 3. As a result, it is possible to rework or regrind the interchangeable cutting element 4 without any unevenness possibly produced in the bearing surface at the seat inside the supporting body 1 having an adverse effect on the cutting behavior. Unevenness, decreasing material thicknesses, material defects or else an oblique seat inside the receptacle 2 are compensated for by the elastic design and the increased contact force in the region of the cutting edge 3, as a result of which the requisite clamping force and desired cutting quality can be maintained for a long time.

Figure 4:
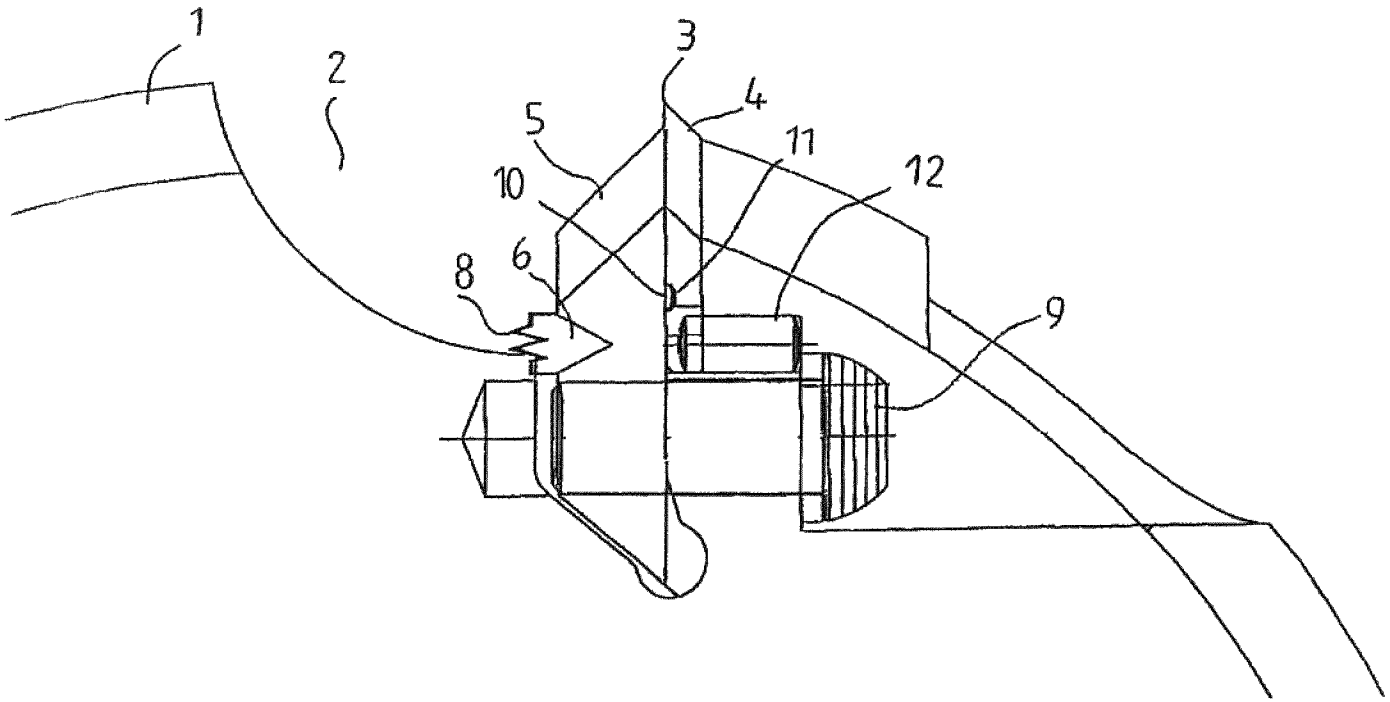
FIG. 4 shows a sectional illustration of the fitted cutting tool.

It becomes clear with reference to FIG. 4, in an assembly drawing, that the projection 10 of the clamping jaw 5 protects the cutting element 4 against a radial displacement in the fitted state, whereas the axial locking element 12 prevents a displacement from the drawing plane or into the drawing plane.

In this case, the receptacle 2, at the radially inner end, is formed in such a way that a correspondingly formed end of the clamping jaw 5 can be pivoted slightly, such that a rotation is produced about this inner point by the screw 9 arranged radially further outward and tension force applied by means of the screw 9. In this way, reliable clamping of the cutting element 4 by the clamping jaw 5 is ensured. The compression spring 8 at the same time presses the outer end of the clamping jaw 5 upward and causes the top section of the clamping jaw 5 to rotate or bend about the region of the weakened material location due to the groove 6.

Figure 5:
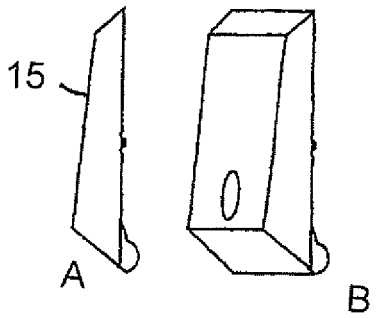

FIGS. 5A to 10B show various illustrations of clamping jaws 5, where each figure identified by the designation A is a sectional illustration and each figure identified by the designation B is an oblique plan view. A slope 15, increasing radially outward, of the clamping jaw 5 is shown in FIG. 5, with which slope 15 a corresponding contact force is applied to the cutting element 4 in the region of the cutting edge 3 after the clamping jaw 5 has been fitted into the cutting tool. The spring effect of the clamping jaw 5 is produced by the reduction in the material in the radially outer end of the clamping jaw 5, such that a whip or leaf-spring effect is achieved, which increases the contact force. Alternatively or in addition, the clamping jaw 5 can also be of curved design in order to increase, in particular, the contact pressure at the inner and outer regions of the cutting element 4.

Figure 6:
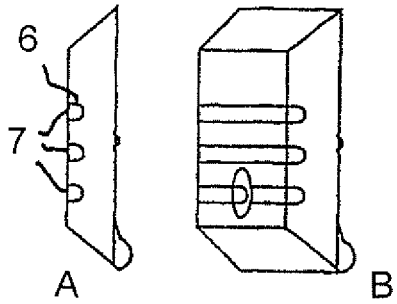
Figure 7:
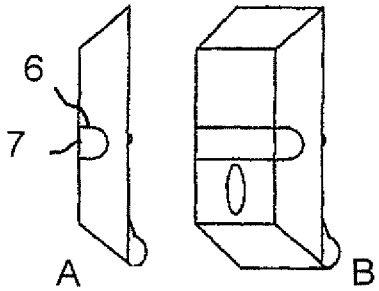

In FIGS. 6 and 7, grooves 6 or a groove 6 are/is milled in the clamping jaw 5 over its entire axial width, in which grooves 6 or groove 6 an elastic spring element, for example an elastic plastic 7, is incorporated in order to achieve a corresponding spring effect. The parallel arrangement of the grooves 6 can be seen in FIG. 6, it being possible to accordingly orient the grooves 6 differently in relation to the external conditions and the intended use.

Figure 8:
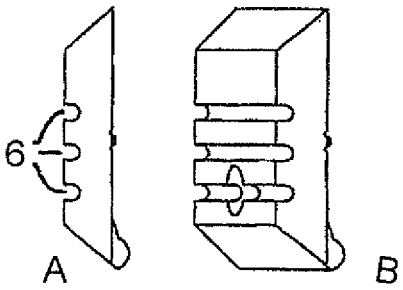
Figure 9:
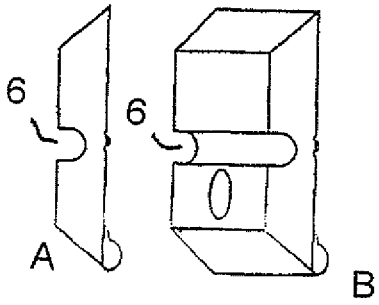

FIGS. 8 and 9 show a clamping jaw 5 having grooves 6 or a groove 5, no spring element being inserted in the groove 6 or the grooves 6. The hinge effect or the spring effect and a corresponding prestress of the clamping jaw 5 can be increased, for example, via an appropriate surface treatment and stress states, produced as a result, within the clamping jaw 5.

Figure 10:
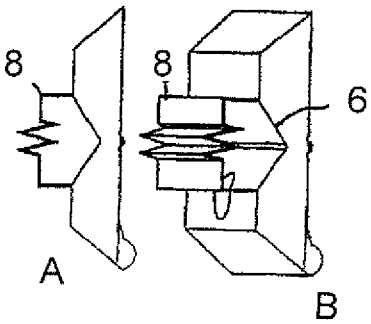

FIG. 10 shows, in an individual illustration, a clamping jaw 5 according to FIGS. 1 to 4, with a schematically shown compression spring 8 arranged in the groove 6, the functioning of said compression spring 8 being explained with respect to FIGS. 1 to 4.

Figure 11:
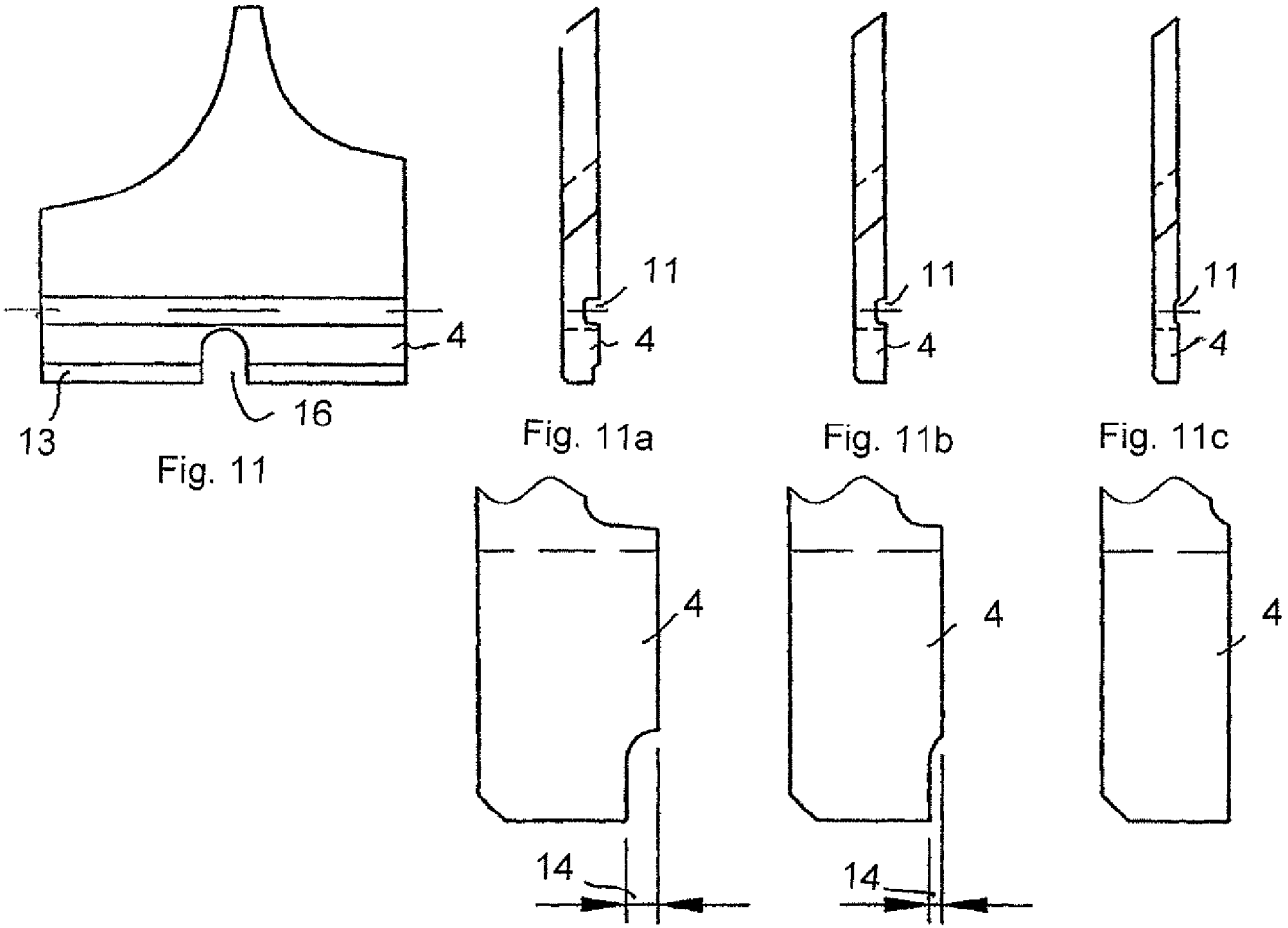
FIG. 11 shows a cutting element in plan view.

Shown in FIG. 11 in a plan view, without the cutting edge 3, is a base part of a cutting element 4 having a recess 16 for accommodating the axial locking element 12. An indicating recess 13 in the form of a groove is ground in the cutting element 4 over the entire width of the latter in order to indicate how far the cutting element 4 can be reground before the minimum material thickness is reached. If regrinding is carried out too frequently, the material thickness of the cutting element 4 decreases, which leads to diminishing strength and to problems for exact and fixed clamping in the cutting tool or supporting body 1 and makes reliable clamping by the clamping jaw 5 more difficult.

The cutting element 4 is shown with its original material thickness in FIG. 11*a* and in the state already reground to the maximum extent in FIG. 11*b*, which can also be seen from the different depths of the recess 11. The depth of the indicating groove 13 is the size for the regrinding zone 14, within which regrinding can safely be carried out. In the illustration in FIG. 11*b*, the end of the regrinding zone is reached. Safe use of the cutters is ensured as long as a thickness difference of the cutters in the region of the rake face and the indicating groove can be recognized. In FIG. 11*c*, the maximum regrinding zone can no longer be determined. These cutters or cutting elements 4 could have a cutter thickness that is too small for the clamping system and therefore must no longer be used. The grinding of the indicating groove 13 has the great advantage that the recess or the groove 13 can be incorporated in an extremely precise manner. As an alternative to a configuration as a groove 13, the recess can also have another form. Provided similary precise processes can be made available, the indicating groove 13 can also be incorporated in the cutting element 4 in another way.

Figure 12:
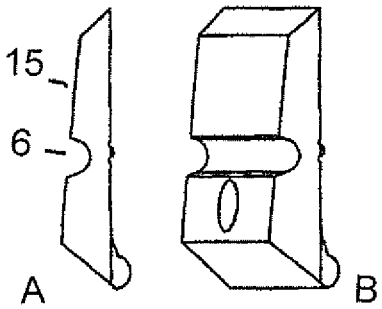

Shown in FIG. 12 is a clamping jaw 5 having a groove 6 running over the entire width of the clamping jaw 5, the clamping jaw 5 at the same time having a slope 15, which leads to increased elasticity and an increased spring effect. The groove 6 is in this case formed with a rounded-off cross section which opens in the direction of the clamping jaw surface and therefore has a parabolic form.

Figure 13:
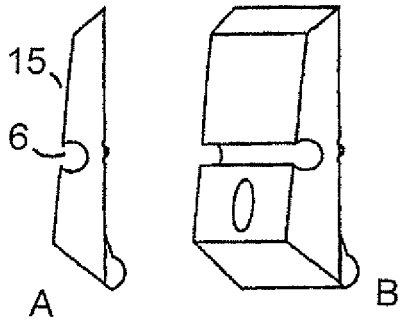

FIG. 13 shows a construction of the clamping jaw 5 similar to that in FIG. 12, although with a different contour of the groove 6, which is designed as a circle segment, with a circumference of more than 180°. As a result, an undercut forms inside the groove 6.

Figure 14:
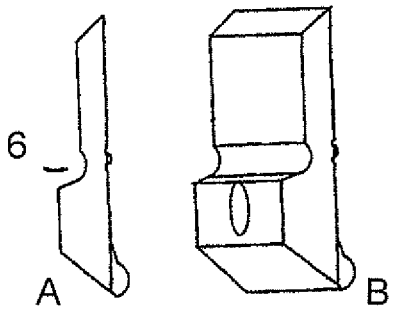

A variant of FIG. 9 is shown in FIG. 14, in which that region of the clamping jaw 5 which is situated radially on the outside is provided with a weakened location by virtue of the fact that some of the material of the clamping jaw 5 has been removed. The contour of the recess or groove 6 likewise differs from that of FIG. 9. The groove shape 6 corresponds to the groove shape of FIG. 12.

Figure 15:
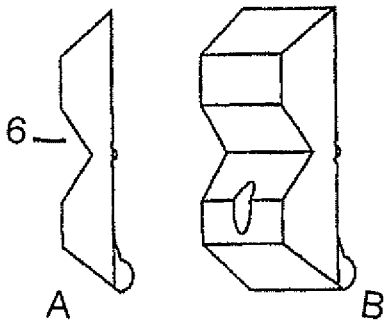

A clamping jaw 5 according to FIG. 10 is shown in FIG. 15 without a spring element 8. The recess 6 is not rounded off but rather is angular. Instead of a rounded-off groove 6 or a groove 6 formed by two inclines, said groove 6 can also be of polygonal design. All the clamping jaws 5 have a tapped hole for accommodating the stud or screw 9.

The invention claimed is:

1. A cutting tool comprising:

a supporting body and at least one receptacle which is arranged in the supporting body;

at least one cutting element having a cutting edge, the at least one receptacle being designed to be open to allow the cutting edge of the at least one cutting element to pass through; and at least one clamping jaw having a width and height which clamps the at least one cutting element in its seat, wherein the at least one clamping jaw is configured to be elastic in the direction of the at least one cutting element and has one or more grooves extending the entire width of the at least one clamping jaw on a side of the clamping jaw opposite the at least one cutting element, wherein the clamping jaw is coupled to the supporting body via a screwed connection and clamps the cutting element such that the width of the at least one clamping jaw is parallel to an axial direction of the supporting body.

2. The cutting tool as claimed in claim 1, wherein the at least one clamping jaw comprises a plurality of grooves extending the entire width of the at least one clamping jaw which are arranged substantially parallel to one another on the side of the clamping jaw opposite the cutting element.

3. The cutting tool as claimed in claim 1, further comprising a spring element arranged in the one or more grooves in the at least one clamping jaw.

4. The cutting tool as claimed in claim 3, wherein the spring element consists of an elastic material or a compression spring.

5. The cutting tool as claimed in claim 1, wherein the at least one clamping jaw consists of a metal or plastic piece prestressed and curved so as to be preloaded elastically against the cutting element.

6. The cutting tool as claimed in claim 1, wherein at least one projection is arranged on the at least one clamping jaw on a side facing the at least one cutting element, said at least one projection engaging in a corresponding recess in the at least one cutting element.

7. The cutting tool as claimed in claim 1, wherein at least one projection is arranged on the at least one cutting element on a side facing the at least one clamping jaw, said at least one projection engaging in a corresponding recess in the at least one clamping jaw.

8. The cutting tool as claimed in claim 6, wherein the at least one projection and the recess are designed for axially and/or radially locking the cutting element.

9. The cutting tool as claimed in claim 1, further comprising an axial locking element arranged on the supporting body for the at least one cutting element.

10. The cutting tool as claimed in claim 1, wherein the at least one cutting element is fastened to the supporting body in an interchangeable manner.

11. The cutting tool as claimed in claim 1, wherein the at least one clamping jaw is elastic in the direction of the cutting edge.

12. The cutting tool as claimed in claim 1, wherein the at least one cutting element comprises a recess which indicates an end of a regrinding zone.

13. The cutting tool as claimed in claim 1, configured as a cutter block or cutter head of a woodworking machine.

14. A cutting tool comprising:

a supporting body having a receptacle incorporated therein;

a cutting element inserted into the receptacle, the receptacle serving as a seat for a cutting element;

a clamping jaw having a width and height which clamps the cutting element arranged opposite the seat; and a screw, clamping of the cutting element being effected by means of the screw which, through a through-hole in the supporting body, engages in a thread incorporated in the clamping jaw and clamps the cutting element in place after application of a fixed torque, wherein incorporated on a side of the clamping jaw opposite the cutting element are one or more grooves extending the entire width of the clamping jaw which result in a weakened location on account of an absence of material, and the weakened location results in a hinge effect about the one or more grooves, wherein the clamping jaw has a projection which engages in a corresponding groove in the cutting element and which, in addition to a clamping force applied by the screw, forms positive locking against a radial displacement of the cutting element on account of centrifugal forces that occur, and wherein the width of the clamping jaw is parallel to an axial direction of the supporting body.

15. A cutting tool comprising:

a supporting body having a receptacle incorporated therein;

a cutting element inserted into the receptacle, the receptacle serving as a seat for a cutting element;

a clamping jaw having a width and height which clamps the cutting element arranged opposite the seat; and a screw, clamping of the cutting element being effected by means of the screw which, through a through-hole in the supporting body, engages in a thread incorporated in the clamping jaw and clamps the cutting element in place after application of a fixed torque, wherein incorporated on a side of the clamping jaw opposite the cutting element are one or more grooves extending the entire width of the clamping jaw which result in a weakened location on account of an absence of material, and the weakened location results in a hinge effect about the one or more grooves, wherein the clamping jaw has a projection which engages in a corresponding groove in the cutting element and which, in addition to a clamping force applied by the screw, forms positive locking against a radial displacement of the cutting element on account of centrifugal forces that occur, wherein an axial locking stud is passed through a hole into the seat of the cutting element in the receptacle, the hole for the axial locking stud being located radially inward of the through-hole for the screw, the screw engaging in a thread of the clamping jaw and having a head which locks the axial locking stud, the clamping jaw forming an opposite bearing surface for the axial locking stud, such that the latter is secured in a fitted state, wherein the cutting element includes a recess, the recess corresponding to the axial locking stud and enclosing the axial locking stud in the fitted state so that a displacement of the cutting element in an axial direction of the supporting body is prevented, and wherein the width of the clamping jaw is parallel to an axial direction of the supporting body.

* * * * *